US009647383B2

(12) United States Patent
Lee et al.

(10) Patent No.: US 9,647,383 B2
(45) Date of Patent: May 9, 2017

(54) RIGHT ANGLE EXIT CONNECTOR ASSEMBLY

(71) Applicant: 3M INNOVATIVE PROPERTIES COMPANY, St. Paul, MN (US)

(72) Inventors: Kok Hoe Lee, Singapore (SG); Saujit Bandhu, Singapore (SG); Dennis L. Doye, Cedar Park, TX (US); YunLong Qiao, Singapore (SG)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 15/106,926

(22) PCT Filed: Dec. 22, 2014

(86) PCT No.: PCT/US2014/071781

§ 371 (c)(1),
(2) Date: Jun. 21, 2016

(87) PCT Pub. No.: WO2015/102976

PCT Pub. Date: Jul. 9, 2015

(65) Prior Publication Data

US 2017/0012385 A1 Jan. 12, 2017

Related U.S. Application Data

(60) Provisional application No. 61/922,165, filed on Dec. 31, 2013.

(51) Int. Cl.
*H01R 13/56* (2006.01)
*H01R 12/62* (2011.01)
(Continued)

(52) U.S. Cl.
CPC ..... *H01R 13/56* (2013.01); *H01R 12/62* (2013.01); *H01R 13/506* (2013.01); *H01R 24/60* (2013.01); *H01R 2107/00* (2013.01)

(58) Field of Classification Search
CPC ..... H01R 11/09; H01R 11/12; H01R 12/53; H01R 2201/26; H01R 43/16; H01R 4/18;
(Continued)

(56) References Cited

U.S. PATENT DOCUMENTS 4,065,199 A * 12/1977 Andre ..... H01B 7/08 174/72 A
4,155,613 A * 5/1979 Brandeau ..... H01B 11/06 174/117 F
(Continued)

FOREIGN PATENT DOCUMENTS

WO WO 2010-121054 10/2010
WO WO 2011-116390 9/2011
WO WO 2014-099331 6/2014

OTHER PUBLICATIONS

Heiss, The Classification of Solvents for bis-phenol-A Polycarbonate, Polymer Engineering and Science, Jul. 1979, vol. 19, No. 9, pp. 625-637.
(Continued)

*Primary Examiner* — Truc Nguyen
(74) *Attorney, Agent, or Firm* — Robert S. Moshrefzadeh

(57) ABSTRACT

Connector assemblies are disclosed. More particularly, connector assemblies including a housing with an inclined wall are disclosed. The inclined wall helps maintain a folded flat cable by contacting substantially its entire fold edge. The housing with the inclined wall may be removably attached to the rest of the connector assembly.

8 Claims, 3 Drawing Sheets

(51) Int. Cl.
*H01R 13/506* (2006.01)
*H01R 24/60* (2011.01)
*H01R 107/00* (2006.01)

(58) Field of Classification Search
CPC ..... H01R 4/184; H01R 4/185; H01R 11/03; H01R 12/57; H01R 12/58; H01R 12/585; H01R 12/7082; H01R 12/75; H01R 12/79
See application file for complete search history.

(56) References Cited

U.S. PATENT DOCUMENTS 5,925,851 A 7/1999 Sugahara
7,076,863 B2 * 7/2006 Mori ..... B60R 16/0207 29/747
8,283,575 B2 * 10/2012 Chuo ..... H05K 1/028 174/254
8,313,340 B2 11/2012 Krueger
8,840,415 B2 * 9/2014 Orris ..... H01R 12/592 439/329
9,225,090 B2 * 12/2015 Chen ..... H01R 12/79
9,300,100 B2 * 3/2016 Abe ..... H01R 35/025
2004/0102082 A1 5/2004 Tsuji
2007/0087620 A1 * 4/2007 Yamamoto ..... B60R 16/0215 439/422
2010/0273335 A1 10/2010 Wu

OTHER PUBLICATIONS

Kambour, "Bisphenol-A Polycarbonate Immersed in Organic Media Swelling and Response to Stress", Macromolecules, Mar.-Apr. 1974, vol. 7, No. 2, pp. 248-253.
International Search Report for PCT International Application No. PCT/US2014/07178, mailed on Apr. 10, 2015, 3pgs.

* cited by examiner

RIGHT ANGLE EXIT CONNECTOR ASSEMBLY

BACKGROUND

Electrical connectors are often used to mate signal-carrying cables with input or output ports. In some applications, many connectors are provided within a limited space or access to the surfaces to which the connectors are mated is difficult. Flat or ribbon-style cables may be particularly susceptible to tangling or twisting.

SUMMARY

In one aspect, the present disclosure relates to a connector assembly. The connector assembly includes a first housing having a mating side for mating with a mating connector and a rear side, a plurality of vertically spaced circuit board cable assemblies disposed within the first housing, each circuit board cable including a printed circuit board (PCB) including an upper surface, an opposing lower surface, a mating end disposed at the mating side of the first housing for engaging a mating connector and a cable end opposite the mating end, a first plurality of conductive contact pads disposed on the upper and lower surfaces at the mating end for engaging terminals of a mating connector, and a second plurality of conductive contact pads disposed on the upper and lower surfaces at the cable end and electrically connector to the first plurality of conductive contact pads and a pair of flat shielded cables, each shielded cable including a plurality of insulated conductors, each insulated conductor including a central conductor surrounded by a dielectric material, and first and second conductive shielding films disposed on opposite first and second sides of the shielded cable, exposed ends of the central conductors in the pair of shielded cables being terminated at the second plurality of conductive contact pads. The connector assembly further includes a second housing removably attached to the first housing and including an input side facing the rear side of the first housing, an exit side from which the pair of shielded cables exits the second housing, and an inclined wall, the pair of shielded cables being folded within the second housing forming a fold edge, the inclined wall maintaining the fold by contacting the pair of shielded cables substantially along the entire fold edge.

In another aspect, the present disclosure relates to a connector assembly including a first housing, a plurality of terminals fixed within the first housing, a second housing removably attached to the first housing and including an inclined wall, and a flat cable disposed within the first and second housings and including a plurality of wires terminated at the plurality of terminals, the flat cable being folded within the second housing forming a folded edge, the inclined wall maintaining the fold by contacting the flat cable substantially along the entire fold edge.

In yet another aspect, the present disclosure relates to a connector attachment for being removably attached to a connector housing of a connector assembly that includes a folded flat cable disposed within the connector housing, the connector attachment including an inclined wall making an acute angle with at least one outermost surface of the connector attachment, such that when the connector attachment is removably attached to a connector housing of a connector assembly that includes a folded flat cable disposed within the connector housing and forming a fold edge, the inclined wall maintains the fold by contacting the flat cable substantially along the entire fold edge.

DETAILED DESCRIPTION

Figure 1:
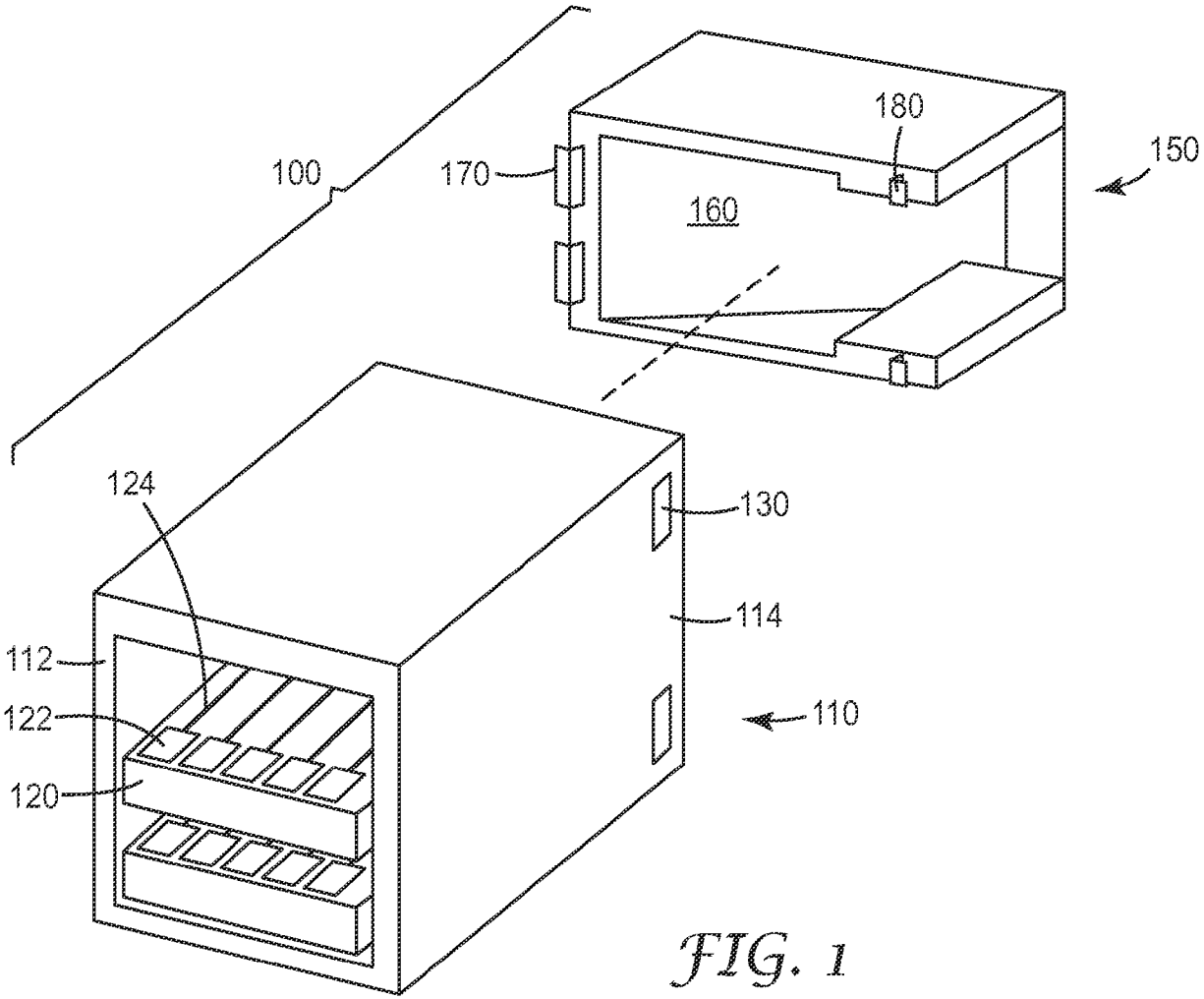
FIG. 1 is an exploded top perspective view of a connector assembly.

FIG. 1 is an exploded top perspective view of a connector assembly. Connector assembly 100 includes first housing 110 and second housing 150. First housing 110 has mating side 112 and rear side 114 and includes a plurality of printed circuit boards (PCB) 120 having conductive contact pads 122, electrical connections 124, and slots 130. Second housing 150 includes inclined wall 160, latches 170, and second latches 180.

First housing 110 includes a plurality of PCB 120. Each PCB has a plurality of conductive contact pads 122 located on both an upper and lower surface. Conductive contact pads 122 are located both near the mating side 112 of first housing 110 and rear side 114 of first housing 114. The conductive contact pads on the rear and lower surfaces of PCB 120 are not shown for ease of illustration. Conductive contact pads 122 are electrically connected by electrical connections 124 to their corresponding contact pad on the opposite side of the same surface or the same side of the opposite surface of PCB 120. For example, the leftmost (from the perspective of FIG. 1) conductive contact pad on the upper surface of the mating side of the upper PCB is electrically connected via an electrical connection to the leftmost conductive contact pad on the upper surface of the rear side of the upper PCB. Electrical connections 124, in some embodiments, may be vias. In this case, for example, the leftmost conductive contact pad on the upper surface of the mating side of the upper PCB is electrically connected through a via to the leftmost conductive contact pad on the lower surface of the mating side of the upper PCB. Combinations of vias and conductive paths are possible in some embodiments. Any suitable number of conductive contact pads 122 may be used on each PCB. The number of conductive contact pads 122 may be the same on each upper and lower surface of PCB 120, or it may be different. Similarly, the number of conductive contact pads between corresponding upper and lower surfaces of each PCB 120 may be the same or may be different. Conductive contact pads 122 and electrical connections 124 may be any suitable or conventional conductive material such as copper, and may be selected for electrical properties such as having high conductivity (or equivalently, low resistivity). Conductive contact pads 122 need not be substantially rectangular, and may be any suitable shape. In some embodiments, conductive contact pads 122 vary in size, shape, or both. Although electrical connections 124 are depicted in FIG. 1 as substantially straight conductive paths, this need not be the case, and the paths may vary based on design considerations. The substrate material of the PCB may be any suitable non-conductive material, such as glass/epoxy resin composite material. The two or more PCB 120 may be spaced apart vertically and mounted within first housing 110 to maintain the spacing. PCB 120 may fit into a slot or groove in first housing 110, may be attached with adhesive to the sides the housing, or may be otherwise secured in place, including through the use of mounting screws and posts.

A pair of flat shielded cables, not shown in FIG. 1 for ease of illustration, has a plurality of insulated conductors. Insulated conductors are a central conductor surrounded by a dielectric material. Conductive shielding films are disposed on opposite first and second sides of the shielded cable to prevent surrounding radiation from affecting the signal and also to minimize leakage of electromagnetic radiation to the environment. The flat shielded cables have exposed ends, where the exposed ends of each of the pair of flat shielded cables terminate at the set of conductive contact pads 122 (i.e., terminals) on the upper surface of PCB 120 at the rear side and the conductive contact pads on the lower surface of PCB 120 at the rear side. The exposed ends of the flat shielded cables may be soldered or otherwise permanently or semi-permanently connected to the conductive contact pads 122 to provide adequate signal transmission from PCB 120 to the conductors within the flat shielded cables. In some embodiments, the number of exposed ends of each flat shielded cable may correspond to the number of conductive contact pads 122. Together the PCB and the attached pair of shielded cables may be considered a circuit board cable assembly. In some embodiments, instead of a pair of flat shielded cables, a single flat shielded cable may be attached to either the upper or lower surface of PCB 120 via the conductive contact pads. In some embodiments one or more of the cable or cables may not be shielded.

Second housing 150 includes inclined wall 160. Inclined wall 160 may form an acute angle with one or more of the outermost surfaces of second housing 150. For purposes of this application, the inclined wall forming an acute angle with one or more of the outermost surfaces of the second housing means the inclined wall lies substantially within a first plane, and an outermost surface of the second housing lies substantially within a second plane, and the intersection of the first plane and second plane form an acute angle. The slope of inclined wall 160 relative to a back surface of second housing 150 (or, in another sense, the angle between the two) may configured to any desirable tilt. For example, in some embodiments, the slope of inclined wall 160 relative to a back surface of second housing 150 may be approximately 45°. In some embodiments, it may be useful to measure or describe the angle between the plane of inclined wall 160 with reference to an entrance plane substantially parallel to the front surface of second housing 150.

Second housing further includes latches 170 and second latches 180. Latches 170 and second latches 180 are designed or configured to fit removably into slots 130. In some embodiments, latches 170 and second latches 180 may be of the same or similar size and shape and located symmetrically on second housing 150, enabling second housing 150 to connect with first housing 110 in either of two configurations: as shown in FIG. 1 or rotated 180° around the connection axis (depicted as the dashed line in FIG. 1). The latches may be any suitable connection mechanism. In some embodiments, the latches may be designed to be easily removable, yet remain securely attached. The latches may incorporate a disconnection mechanism such as a button or tab, where pressing, sliding, or otherwise manipulating the mechanism disengages second housing 150 from first housing 110. The second housing may be referred to as a connector attachment, being removably attachable to the rest of connector assembly 100.

The shape and size of both first housing 110 and second housing 150 may be chosen to have desirable physical properties, such as being light weight or low profile. Nonetheless, the sizes may be chosen to be similar to better enable removable connections between the two.

Either or both of first housing 110 and second housing 150 may be formed through any suitable process, such as injection molding or even 3D printing (including both additive and subtractive processes). The first and second housings may be any suitable material, which may be chosen for its manufacturabilty, physical, and electrical properties. For example, the materials for the first and second housings may be chosen to be durable or melt resistant. The shapes of first housing 110 and second housing 150 may be selected based on the dimensions of the cables used with cable assembly 100. In some embodiments, the first and second housings may be plastic parts.

Figure 2:
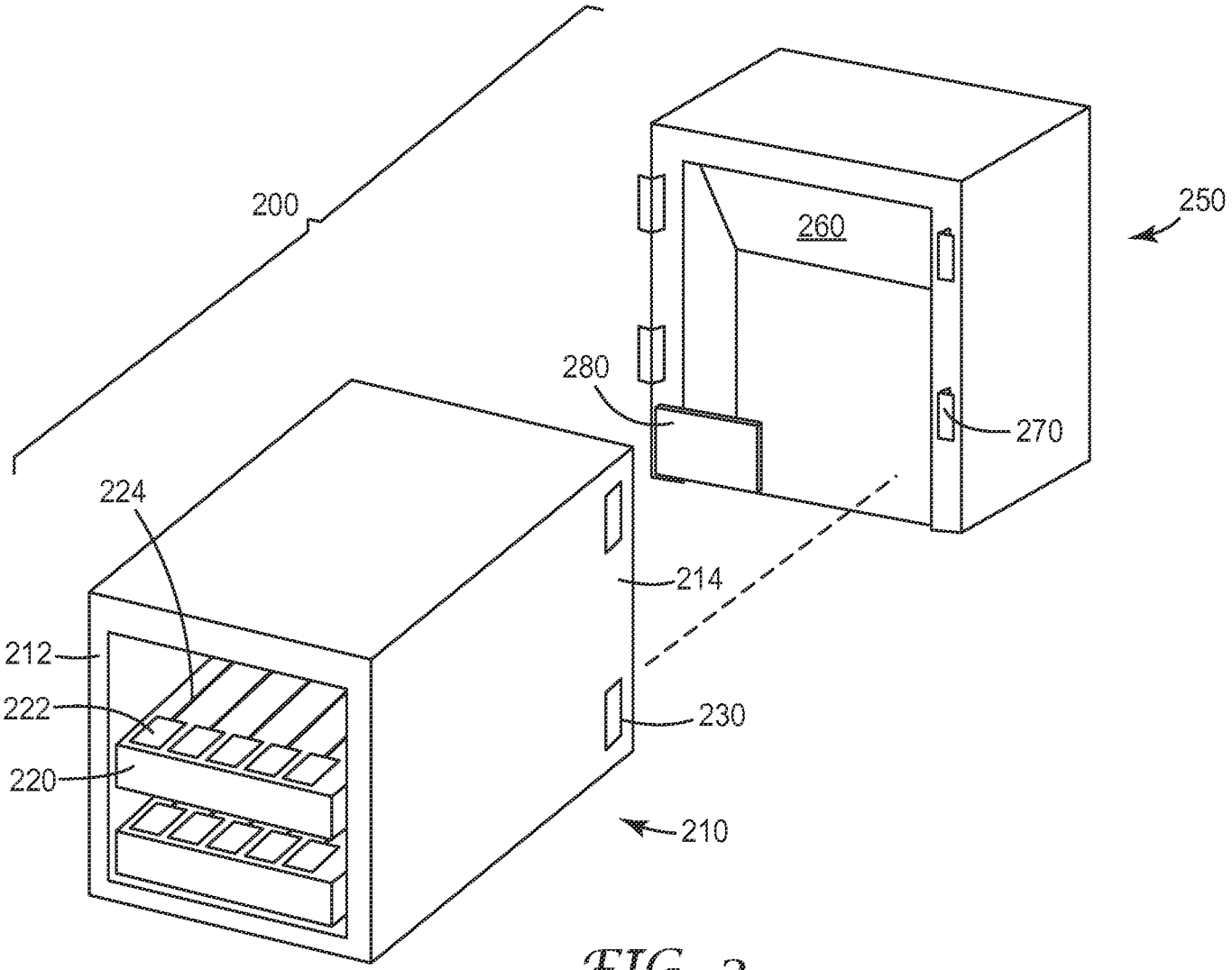
FIG. 2 is an exploded top perspective view of another connector assembly.

FIG. 2 is an exploded top perspective view of another connector assembly. Connector assembly 200 includes first housing 210 and second housing 250. First housing 210 has mating side 212 and rear side 214 and includes a plurality of printed circuit boards (PCB) 220 having conductive contact pads 222 and electrical connections 224 and slots 230. Second housing 250 includes inclined wall 260, latches 270, and cable retainer 280.

First housing 210 and its components and features correspond to first housing 110 in FIG. 1. Second housing 250 includes inclined wall 260. Inclined wall 260 may form an acute angle with one or more of the outermost surfaces of second housing 250. In some embodiments and as depicted in FIG. 2, inclined wall 260 be shorter and steeper than inclined wall 160 in FIG. 1. Second housing includes latches 270. Latches 270 may be symmetrically configured and may be of similar size and shape to allow second housing 250 to be attached as it is shown in FIG. 2 or, alternatively, upside down.

Second housing 250 further includes cable retainer 280 which may help to keep the flat shielded cable secure as it passes through both the first and second housings. In some embodiments, the cable retainer 280 is a simple rigid component that extends into the front plane of second housing 250 and may be any suitable shape or size. As for connector assembly 100 in FIG. 1, first housing 210 and second housing 250 may be removably connected.

Figure 3:
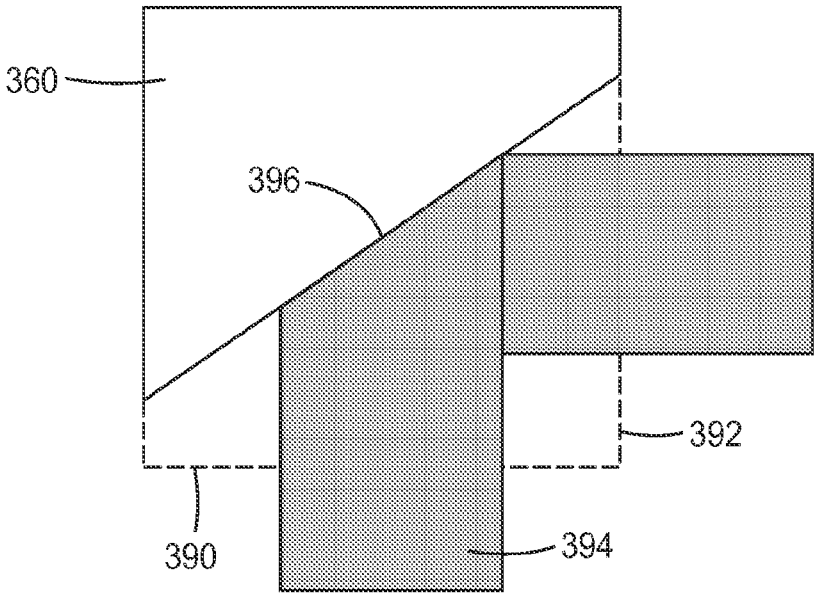
FIG. 3 is a top plan schematic of a flat cable contacting the inclined wall of the connector assembly of FIG. 1.

FIG. 3 is a top plan schematic of a flat cable contacting the inclined wall of the connector assembly of FIG. 1. FIG. 3 essentially depicts the entrance and exit of a flat cable through the second housing 150 in FIG. 1. FIG. 3 shows inclined wall 360, entrance plane 390, exit plane 392, and cable 394 having fold edge 396. With reference to FIG. 1, entrance plane 390 substantially corresponds to the front plane of second housing 150, while exit plane 392 substantially corresponds to the right plane of second housing 150.

When cable 394 is folded to change direction while remaining in substantially the same (or parallel) plane, fold edge 396 is created. Fold edge 396 contacts inclined wall 360. In this way inclined wall 360 maintains the fold through contacting cable 394 substantially along the entire fold edge. Cable 394 may be a pair or more of shielded cables stacked on one another, and in this case, the fold edge 396 may be considered to be the folded edge of the stack of shielded cables. Thus, inclined wall 360 may be considered to effectively contact cable 394 in the aggregate even though it may not contact each shielded cable.

Figure 4:
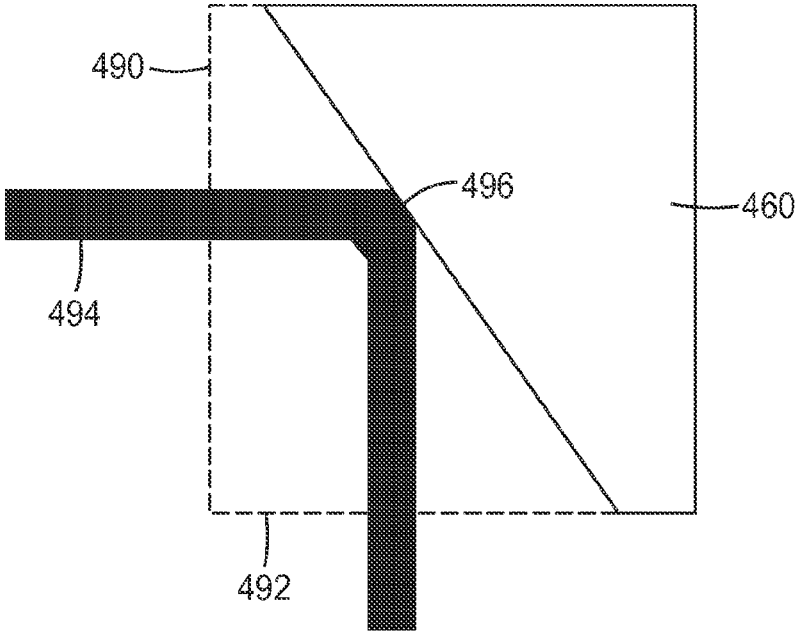
FIG. 4 is a side elevation schematic of a flat cable contacting the inclined wall of the connector assembly of FIG. 2.

FIG. 4 is a side elevation schematic of a flat cable contacting the inclined wall of the connector assembly of FIG. 2. FIG. 4 essentially depicts the entrance and exit of a flat cable through the second housing 250 in FIG. 2. FIG. 4 shows inclined wall 460, entrance plane 490, exit plane 492, and cable 494 having fold edge 496. With reference to FIG. 2, entrance plane 490 substantially corresponds to the front plane of second housing 250, while exit plane 492 substantially corresponds with the bottom plane of second housing 250.

In FIG. 4, cable 494 has been folded to change direction to a substantially orthogonal plane, creating fold edge 496. Fold edge 496 contacts inclined wall 460. In this way inclined wall 460 maintains the fold through contacting cable 496 substantially along the entire fold edge. As described for corresponding cable 394 in FIG. 3, cable 494 may be a pair or more of shielded cables stacked on one another, and in this case, the fold edge 496 may be considered to be the folded edge of the stack of shielded cables. Inclined wall 460, therefore, may be considered to effectively contact cable 494 in the aggregate even though it may not contact each shielded cable.

Descriptions for elements in figures should be understood to apply equally to corresponding elements in other figures, unless indicated otherwise. The present invention should not be considered limited to the particular embodiments described above, as such embodiments are described in detail in order to facilitate explanation of various aspects of the invention. Rather, the present invention should be understood to cover all aspects of the invention, including various modifications, equivalent processes, and alternative devices falling within the scope of the invention as defined by the appended claims and their equivalents.

What is claimed is:

1. A connector assembly comprising:

a first housing having a mating side for mating with a mating connector and a rear side; a plurality of vertically spaced apart circuit board cable assemblies disposed within the first housing, each circuit board cable assembly comprising:

a printed circuit board (PCB) comprising an upper surface, an opposing lower surface, a mating end disposed at the mating side of the first housing for engaging a mating connector and a cable end opposite the mating end, a first plurality of conductive contact pads disposed on the upper and lower surfaces at the mating end for engaging terminals of a mating connector, and a second plurality of conductive contact pads disposed on the upper and lower surfaces at the cable end and electrically connected to the first plurality of conductive contact pads; and a pair of flat shielded cables, each shielded cable comprising a plurality of insulated conductors, each insulated conductor comprising a central conductor surrounded by a dielectric material, and first and second conductive shielding films disposed on opposite first and second sides of the shielded cable, exposed ends of the central conductors in the pair of shielded cables being terminated at the second plurality of conductive contact pads; and a second housing removably attached to the first housing and comprising an input side facing the rear side of the first housing, an exit side from which the pair of shielded cables exits the second housing, and an inclined wall, the pair of shielded cables being folded within the second housing forming a fold edge, the inclined wall maintaining the fold by contacting the pair of shielded cables substantially along the entire fold edge.

2. The connector assembly of claim 1, wherein the pair of flat shielded cables within the first housing generally extend along a horizontal plane, the inclined wall making an acute angle with the horizontal plane.

3. The connector assembly of claim 1, wherein the inclined wall makes an acute angle with an outermost top surface of the second housing.

4. The connector assembly of claim 1, wherein the inclined wall makes an acute angle with an outermost side surface of the second housing.

5. The connector assembly of claim 1, wherein the pair of flat shielded cables generally extend along a first plane before the fold and along a second plane after the fold, the second plane being parallel to the first plane.

6. The connector assembly of claim 1, wherein the pair of flat shielded cables generally extend along a first plane before the fold and along a second plane after the fold, the second plane being perpendicular to the first plane.

7. A connector assembly comprising:

a first housing;

a plurality of terminals fixed within the first housing;

a second housing removably attached to the first housing and comprising an inclined wall; and a flat cable disposed within the first and second housings and comprising a plurality of wires terminated to the plurality of terminals, the flat cable being folded within the second housing forming a folded edge, the inclined wall maintaining the fold by contacting the flat cable substantially along the entire fold edge.

8. A connector attachment for being removably attached to a connector housing of a connector assembly that includes a folded flat cable disposed within the connector housing, the connector attachment comprising an inclined wall making an acute angle with at least one outermost surface of the connector attachment, such that when the connector attachment is removably attached to the connector housing of the connector assembly that includes the folded flat cable disposed with the connector housing and forming a fold edge, the inclined wall maintains the fold by contacting the flat cable substantially along the entire fold edge.

* * * * *